US009913502B2

(12) United States Patent
Koga et al.

(10) Patent No.: US 9,913,502 B2
(45) Date of Patent: Mar. 13, 2018

(54) GLOVE BASE AND GLOVE

(71) Applicant: TOWA CORPORATION CO., LTD., Kurume-Shi (JP)

(72) Inventors: Nobuyoshi Koga, Kurume (JP); Akinori Yamaguchi, Kurume (JP); Mai Kojio, Kurume (JP)

(73) Assignee: Towa Corporation Co., Ltd., Kurume-Shi (JP)

( * ) Notice: Subject to any disclaimer, the term of this patent is extended or adjusted under 35 U.S.C. 154(b) by 0 days.

(21) Appl. No.: 15/372,646

(22) Filed: Dec. 8, 2016

(65) Prior Publication Data

US 2017/0099890 A1 Apr. 13, 2017

Related U.S. Application Data

(63) Continuation of application No. PCT/JP2016/058883, filed on Mar. 22, 2016.

(30) Foreign Application Priority Data

May 25, 2015 (JP) ..... 2015-105886
Feb. 29, 2016 (JP) ..... 2016-037189

(51) Int. Cl.
*A41D 19/00* (2006.01)

(52) U.S. Cl.
CPC ..... *A41D 19/0082* (2013.01); *A41D 2400/60* (2013.01)

(58) Field of Classification Search
CPC .. A41D 19/00; A41D 19/0006; A41D 19/001; A41D 19/0065; A41D 19/0082
(Continued)

(56) References Cited

U.S. PATENT DOCUMENTS 6,226,472 B1 * 5/2001 Yun ..... G03G 15/5004 399/81
6,403,216 B1 * 6/2002 Doi ..... D01F 6/70 428/364
(Continued)

FOREIGN PATENT DOCUMENTS

JP S53-92402 U 7/1978
JP 3038460 U 4/1997
(Continued)

OTHER PUBLICATIONS

Japanese Office Action (Application No. 2016-037189 dated Nov. 22, 2016 (with English translation).
(Continued)

*Primary Examiner* — Gloria Hale
(74) *Attorney, Agent, or Firm* — Burr & Brown, PLLC

(57) ABSTRACT

A glove base and glove are provided, which release moisture outside from the entire glove when the glove is configured only of a fiber glove base or when a coating is provided to a surface of the glove base. The glove base of the present invention is made of fibers and has a hand shape. Water-absorbing properties of a first fiber type exposed mainly to an inside surface of the glove base are higher than water-absorbing properties of a second fiber type exposed mainly to outside surface of the glove base. The first fiber type absorbs and moves moisture on a surface of a hand inside the glove base toward the second fiber type, and the second fiber type then moves the moisture from the first fiber type mainly in a surface direction of the glove base.

12 Claims, 6 Drawing Sheets

(58) Field of Classification Search
USPC ..... 2/164, 167, 169, 159, 161.2, 161, 161.3, 2/161.6, 161.7, 161.8
See application file for complete search history.

(56) References Cited

U.S. PATENT DOCUMENTS

| | | | | |
|---|---|---|---|---|
| 2003/0077966 | A1* | 4/2003 | Torii | D02G 3/04 442/181 |
| 2009/0117799 | A1* | 5/2009 | Yoshida | D02G 3/04 442/182 |
| 2017/0099890 | A1* | 4/2017 | Koga | A41D 19/0082 |

FOREIGN PATENT DOCUMENTS

| | | | |
|---|---|---|---|
| JP | 2001-279507 | A1 | 10/2001 |
| JP | 2003-064511 | A1 | 3/2003 |
| JP | 2007-009346 | A1 | 1/2007 |
| JP | 3169287 | U | 7/2011 |
| WO | 2004/041011 | A1 | 5/2004 |

OTHER PUBLICATIONS

International Search Report and Written Opinion (Application No. PCT/JP2016/058883) dated Jun. 14, 2016.

* cited by examiner

GLOVE BASE AND GLOVE

FIELD OF THE INVENTION

The present invention relates to a glove base and glove which, when worn on a hand, quickly absorbs moisture such as sweat occurring on a surface of the hand so that hardly any moisture remains on the surface of the hand in the glove.

BACKGROUND OF THE INVENTION

Various gloves are used in various scenes such as manufacturing work at factories, farm work, gardening, light work, construction work, and cooking work. A glove protects a hand of a worker and makes work efficient. There are gloves of a type obtained by weaving fibers, such as a work glove, and gloves of a type using rubber or resin for the purpose of providing airtightness and waterproofness.

The latter glove, configured of rubber or resin, is used when airtightness and waterproofness are top priorities. Such a glove configured only of a layer made of rubber, resin, or the like has high airtightness and waterproofness, but hardly absorbs moisture occurring on the surface of the hand in the glove. Thus, a user wearing the glove feels uncomfortable due to moisture feelings or the like on the hand in the glove. Such a glove configured only of a layer made of rubber, resin, or the like does not address wearing comfort, but rather is used when airtightness and waterproofness are required as the top priorities. For example, this type of glove is used for working in food factories, cooking work, fishery processing factories, and so forth.

On the other hand, there is a glove configured a fiber-made glove base. This glove base is used, as is, as a work glove, for example. Such a glove configured only of a fiber-made glove base is used when airtightness and waterproofness are not required as the top priorities. As a matter of course, since the type of glove is configured only of a fiber-made glove base, in addition to providing good wearing comfort, breathability is high, and moisture feelings can be reduced when the glove base is worn.

Also, there is also a glove with a coating provided to at least part of a surface of a fiber-made glove base. Since the glove base is fiber-made, the wearing comfort when worn is good. In the case of the glove configured only of a layer made of rubber or resin, this rubber or resin layer is in direct contact with the surface of the hand, and therefore, the wearing comfort is not good. By contrast, in a glove with a coating provided to the fiber-made glove base, the fiber-made glove base is in contact with the surface of the hand when used, and, therefore, the wearing comfort is good.

In this manner, to enhance operability with good wearing comfort, a glove with a coating provided to at least part of the surface of the fiber-made base is also used. The coating provided to the surface may have a function and structure to enhance gripping ability, or may have a function and structure to enhance waterproofness and airtightness. To achieve improvement of gripping ability and improvement of airtightness, waterproofness and other functions that cannot be achieved only by this fiber-made glove base, a coating is provided to at least part of the surface of the fiber-made base.

In this manner, the glove configured only of the fiber-made base is used when wearing comfort and use comfort are prioritized. In particular, when gripping ability, airtightness, waterproofness, and so forth, which are more than achievable by the fiber-made base, are not required, the glove made only with the fiber-made glove base is used.

Alternatively, when gripping ability, airtightness, waterproofness, and so forth, which are difficult to be achieved only by the fiber-made base, are desired to be achieved while maintaining the wearing and use comfort, a glove with a coating provided to at least part of the surface of the fiber-made glove base is used.

In this manner, among gloves of various structures, a glove with a basic fiber-made glove base is also used. In the glove with a basic fiber-made base, when worn on a hand, the glove covers the surface of the hand. Thus, even the glove with a basic fiber-made base has a problem in that moisture such as sweat on the surface of the hand causes an uncomfortable feeling (moisture feeling) when worn.

Several technologies for reducing uncomfortable feelings upon wearing this basic fiber-made base glove have been suggested (for example, refer to PTL 1, PTL 2, and PTL 3).

CITATION LIST

Patent Literature

PTL 1: Japanese National Publication of International Patent Application No. WO2004-041011

PTL 2: Japanese Patent Application Laid-Open No. 2001-279507

PTL 3: Japanese Utility Model Registration No. 3038460

In PTL 1, a glove is made with a line of thread appearing on a front surface of the glove and a line of thread appearing on a rear surface, and a ratio of a water absorption and diffusion area of the front surface with respect to the rear surface is 1.3 times or larger, thereby allowing sweat from the skin to move from the inside of the glove to the outside and transpired into the atmosphere, and allowing a reduction in a moisture feeling of the glove when worn. As a result, a glove that offers excellent wearing comfort, even if the glove is worn over a long period of time. For this, in the fiber-made glove, either one line of thread between the line of thread appearing on the front surface of the glove and the line of thread appearing on the rear surface is preferably set to have a fiber space ratio of 88 to 98%, and also either one is preferably configured mainly of filament crimped yarn and the other is preferably configured mainly of spun yarn.

In the fiber-made glove of the PTL 1, the water absorption and diffusion area of the front surface (outside) of the fiber-made glove is set to be 1.3 times or larger than that of the water absorption and diffusion area of the rear surface (inside) of the fiber-made glove. Due to the water absorption and diffusion area on the outside being high, the fiber-made glove reduces the moisture feeling on a hand inside the glove by moving sweat on the hand from inside to outside of the glove.

However, uncomfortable moisture feelings when the glove is worn largely depend on moisture such as sweat on the surface of the hand that remains on the surface of the hand. The glove of PTL 1 is configured to have a low water absorption and diffusion area on the inside in contact with the surface of the hand compared with the outside. Thus, the glove of PTL 1 has a problem in which the inner water-absorbing properties of the fiber-made glove are relatively low and moisture on the surface of the hand cannot be sufficiently absorbed. This is because the outer water absorption and diffusion area is higher than that of the inner surface, therefore, the water-absorbing ability of the entire glove, and the water-absorbing properties of the inside of the fiber-made glove that is in contact with the surface of the hand are relatively inferior.

Also, the inside of the glove in contact with the surface of the hand also has relatively low diffusibility of the absorbed moisture compared with the outside of the glove. Thus, the moisture absorbed by the inside of the glove hardly diffuses and tends to remain at a water-absorbed region. As a result, uncomfortable wearing feelings occur in which sweat absorbed where sweat tends to occur continuously remains at the same site. In this manner, with the water-absorbing properties and diffusibility of the inside of the glove being relatively lower than those of the outside, the absorption of moisture on the surface of the hand and also the release of moisture to the outside tends not to work. As a result of these, the glove of PTL 1 has a problem in that the reduction of uncomfortable wearing feelings such as a moisture feeling is insufficient.

PTL 2 discloses a glove in which water-repellent fiber strings 2 and water-absorbing fiber strings 3 are subjected to a plated stitch by knitting means, with the water-repellent fiber strings 2 being exposed to an entire outer surface 4 of the glove and the water-absorbing fiber strings 3 being exposed to an entire inner surface 5 of the glove.

An object of PTL 2 is to absorb moisture on a surface of a hand in the glove by exposing the water-absorbing fiber to the inside in the fiber-made glove.

However, since the surface of the glove is configured by water-repellent fibers, the inside of the glove has a problem in that the moisture absorbed from the surface of the hand remains inside the glove. If the absorbed moisture remains inside the glove, there is a problem that moisture feelings occur for the glove as a whole, and uncomfortable feelings when the glove is worn cannot be reduced.

In PTL 3, a glove 10 has a two-layer structure with an inner layer 12 of knitted cloth of polypropylene and an outer layer 14 of knitted cloth of silk. On the inside of the glove, in contact with the skin, the inner layer 12 of non-water-absorbing fiber (polypropylene) is provided, and the outer layer 14 of water-absorbing fiber (silk) is provided on the outside of the glove, thereby forming a two-layer structure. In this glove 10, while the polypropylene of the inner layer 12 does not contain or retain moisture, the silk of the outer layer 14 absorbs moisture derived from sweat and outside air. However, since the outer layer 14 and the skin do not directly make contact with each other, the outer layer 14 does not absorb moisture well so as to sufficiently dry the skin. Therefore, if this glove 10 is used, the skin is not dried, which causes rough skin.

In PTL 3, contrary to PTL 2, non-water-absorbing fibers are provided inside the glove in contact with a surface of a hand, and water-absorbing fibers are outside the glove. As a result, even if outside air is dry, the glove can absorb moisture in the air to enhance humidity of the entire glove, which is an object thereof.

However, naturally, with the low water-absorbing properties inside the glove, moisture on the surface of the hand cannot be absorbed. As a result, there is a problem that the moisture feelings of the hand when the glove is worn increase, and uncomfortable wearing feelings cannot be reduced.

In this manner, the glove with a basic fiber-made base according to the conventional technologies has a problem that the uncomfortable feeling, such as moisture feeling caused by moisture on the surface of the hand, cannot be sufficiently reduced. For example, there is a problem that moisture is left in the glove as a whole even if the inside of the glove absorbs moisture on the surface of the hand, and the uncomfortable moisture feeling cannot be sufficiently reduced. Alternatively, there is a problem that moisture on the surface of the hand cannot be sufficiently absorbed.

Also, when a coating is provided to the surface of the fiber-made gloves according to the conventional technology disclosed in PTLs 1 to 3, there is a problem in that the moisture feelings remain.

In view of these problems, an object of the present invention is to provide a glove base and glove that enhances the water-absorbing properties for moisture on a surface of a hand and easily release moisture to the outside from the entire glove when the glove is configured only of a fiber-made glove base or when a coating is provided to a surface of the glove.

SUMMARY OF THE INVENTION

In view of the above problems, a glove base of the present invention is a glove base made of fibers and having a hand shape, wherein the water-absorbing properties of first fibers that are exposed mainly to an inside surface of the glove base are higher than the water-absorbing properties of second fibers that are exposed mainly to an outer surface (outside) of the glove base, the first fibers absorb and move moisture on a surface of a hand inside the glove to the second fibers, and the second fibers move the moisture from the first fibers mainly in a surface direction of the glove base toward the outer surface of the glove base.

In the glove base of the present invention, water-absorbing properties of the inside of the glove that contact the surface of the hand in the glove are relatively higher than those of the outer surface of the glove base (outside). As a result, it is possible to reliably absorb moisture on the surface of the hand early when the glove is worn. With this absorption, less moisture tends to remain on the surface of the hand, and the uncomfortable wearing feelings can be reduced.

Also, in the glove base of the present invention, since the water-absorbing properties of the fibers on the inside surface of the glove base material are higher than the water-absorbing properties of the fibers on the outer surface of the glove base material (outside), moisture movement in a planar surface direction with respect to the surface of the glove base is more easily generated than that in a perpendicular direction with respect to a thickness of the glove base material. With this moisture movement in the planar surface direction, moisture in the entire glove base dissipates, and uncomfortable wearing feelings can be further reduced. In addition, during moisture movement in the planar surface direction, moisture can be released from the outer surface of the glove base to the outside air. Together with this release, the glove base can reduce uncomfortable wearing feelings such as moisture feelings.

Furthermore, with this moisture movement and diffusion in the planar surface direction, even if the glove base is a glove having a coating provided to at least part of the surface of the glove base material, moisture moves to a break in the coating, such as at the wrist. As a result, even if the glove is covered by coating, moisture absorbed by the glove base material moves in the planar surface direction to be released to the outside at the break in the coating. With this release, the glove base of the present invention can reduce uncomfortable wearing feelings such as moisture feelings even if a coating is provided.

DETAILED DESCRIPTION OF THE INVENTION

Figure 1:
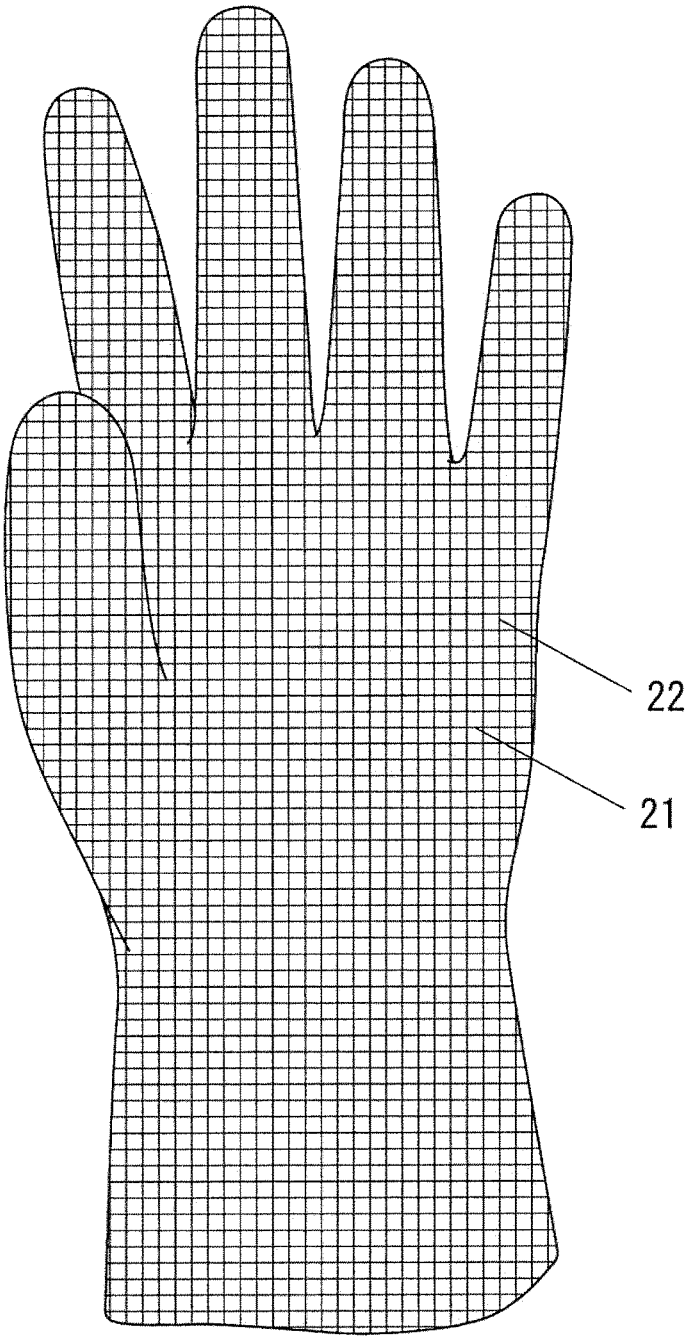
FIG. 1 is a front view of a glove base in a first embodiment of the present invention.

A glove base according to a first aspect of the present invention is made of a fiber material and has a hand shape, wherein the water-absorbing properties of first fibers exposed mainly to the inside surface of the glove base are higher than the water-absorbing properties of second fibers exposed mainly to the outside (outer surface) of the glove base. The first fibers absorb and move moisture on a surface of a hand inside the glove base toward the second fibers, and the second fibers move the moisture from the first fibers mainly in a planar surface direction of the glove base material.

With this structure, the glove base material absorbs moisture on the surface of the hand early and diffuses and releases the absorbed moisture. With this combination of the mechanisms of the first fibers and the second fibers, a state of reduced moisture on the surface of the hand can be achieved and maintained, and moisture feelings can be reduced.

In the glove base according to a second aspect of the present invention, in addition to the first aspect, the water-absorbing properties of the first fibers is 2.0 to 37.5 times that of the water-absorbing properties of the second fibers.

With this structure, the first fibers that are exposed mainly to the inside of the glove base efficiently absorb moisture on the surface of the hand with relatively high water-absorbing properties. As a result, a moisture-free state can be maintained on the surface of the hand in the glove base.

In the glove base according to a third aspect of the present invention, in addition to the first or second aspect, the water-absorbing properties include an amount of water absorption per unit area or unit volume.

With this structure, the water-absorbing properties of the first fibers are high.

In the glove base according to a fourth aspect of the present invention, in addition to any of the first to third aspects, on the inside of the glove base, the first fibers move the moisture absorbed from the surface of the hand mainly in a substantially perpendicular direction through a thickness direction of the glove base toward the second fibers.

With this structure, the first fibers can efficiently absorb moisture on the surface of the hand and ensure that hardly any moisture remains on the surface of the hand in the glove base.

In the glove base according to a fifth aspect of the present invention, in addition to any of the first to fourth aspects, on the outside of the glove base material, the second fibers move the moisture from the first fibers toward an end part of the glove base.

With this structure, even if a coating is provided on a part of the outside (outer surface) of the glove base material, the second fibers discharge moisture to the outside environment via the end part.

In the glove base according to a sixth aspect of the present invention, in addition to the fifth aspect, the end part is an end part of a wrist portion of the glove base.

With this structure, moisture can be released to the outside environment from the wrist portion, which is less apt to be provided with a coating.

In the glove base according to a seventh aspect of the present invention, in addition to any of the first to sixth aspects, when a coating is provided to at least part of a front side surface of the glove base, the second fibers move the moisture from the first fibers to a portion of the glove base that is not provided with the coating in order to release the moisture to the outside air.

With this structure and the combination of the mechanisms of the first fibers and the second fibers, moisture on the surface of the hand can be efficiently absorbed by the glove base and then released to the outside environment. As a result, unpleasant moisture feelings on the hand are reduced.

In the glove base according to an eighth aspect of the present invention, in addition to any of the first to seventh aspects, the moisture mobility of the first fibers is higher in the substantially perpendicular direction than along the planar surface direction of the glove base, and the moisture mobility of the second fibers is higher in the planar surface direction than in the substantially perpendicular direction.

With this structure, the first fibers quickly absorb moisture on the surface of the hand. As a result, it is easy to maintain a state where hardly any moisture remains on the surface of the hand.

In the glove base according to a ninth aspect of the present invention, in addition to any of the first to eighth aspects, the first fibers include at least one type of fibers selected from the group consisting of cotton, hemp, silk, wool, rayon, cupra, and nylon with high moisture absorbing/releasing properties.

With this structure, the first fibers achieve higher water-absorbing properties than those of the second fibers.

In the glove base according to a tenth aspect of the present invention, in addition to any of the first to ninth aspects, the second fibers include at least one type of fibers selected from the group consisting of normal nylon, polyester, vinylon, vinylidene, polypropylene, and polyethylene.

With this structure, the second fibers have lower water-absorbing properties than those of the first fibers. With these relatively low water-absorbing properties, the diffusibility of the second fibers is made higher than that of the first fibers.

In the glove base according to an eleventh aspect of the present invention, in addition to the tenth aspect, the moisture absorbing/releasing properties of the nylon with high moisture absorbing/releasing properties of the first fibers are at least twice as high as the moisture absorbing/releasing properties of the normal nylon of the second fibers.

With this structure, the first fibers can achieve higher water-absorbing properties than those of the second fibers.

In the glove base according to a twelfth aspect of the present invention, in addition to any of the first to eleventh aspects, by using a plating stitch, the first fibers are exposed to the inside surface of the glove base and the second fibers are exposed to the outside (outer surface) of the glove base.

With this structure, the fibers inside and outside the glove base can be provided in the desired state.

In the following, embodiments of the present invention are described.

First Embodiment

As in PTLs 1 to 3 in the description of the conventional technologies, efforts have been made toward reducing the uncomfortable moisture feelings due to moisture such as sweat on the surface of the hand when the glove is worn. For example, as in PTL 1, the technology of increasing the water absorption and diffusion area outside a fiber-made glove to be more than that inside. Alternatively, as in PTL 2, the technology has been suggested in which water-absorbing fibers are inside of a fiber-made glove and water-repellent fibers are outside thereof.

In both of PTLs 1 and 2, by changing the characteristics of the fibers inside and outside the fiber-made glove, uncomfortable feelings such as moisture are reduced when the glove is worn. However, from various studies, the inventors have concluded that the following requirements are necessary to reduce the moisture feelings.

1: High Absorbability of Moisture on the Surface of Hand

An object of PTL 1 is to reduce moisture feelings by making a difference between the water absorption and diffusion areas inside and outside the glove. However, the water-absorbing properties and diffusibility exert different mechanisms in reducing moisture feelings. From various studies, the inventors have concluded that, as a factor in causing moisture feelings by the glove, moisture such as sweat occurring on the surface of the hand remains on the surface of the hand for a long period of time when the glove is worn.

Thus, the inventors have concluded that the high water-absorbing properties on the inside of the glove in contact with the surface of the hand in the glove base are required to reduce moisture feelings. By contrast, PTL 1 is directed to making the water-absorbing properties outside the fiber-made glove relatively higher than those inside, and the problem remains that moisture on the surface of the hand also tends to remain.

In PTL 2, since water-absorbing fibers are used inside the glove, it can be thought that moisture on the surface of the hand could be efficiently absorbed. However, since the outside of the inner fibers are covered with a water-repellent fiber, the absorbed moisture remains in the water-absorbing fiber inside the glove. Thus, if more moisture than that which is absorbable by the inside occurs, a problem also occurs in that the moisture on the surface of the hand cannot be sufficiently absorbed.

In this manner, the inventors have concluded that higher water-absorbing properties inside the glove base than those outside, and maintaining these high water-absorbing properties, are required to decrease the moisture feelings.

2: Diffusibility of Absorbed Moisture on the Surface of a Hand

The inventors have concluded that the high absorbability of moisture on the surface of the hand is limited by covering the outside of the glove made of water-repellent fiber as in PTL 2. As a result, the inventors have concluded that the outside of the glove base must diffuse moisture absorbed by the inside of the glove base.

In particular, they have concluded that the outside of the glove base is required to diffuse and move moisture from the inside in a surface direction (along the surface of the glove base). Together with the above item 1, they have concluded that, in a fiber-made glove base, fibers with different characteristics are exposed to the inside and the outside, and the inside is required to have relatively high water-absorbing properties and the outside is required to have relatively high mobility in the surface direction.

Note that in PTL 1, the water-absorbing properties and diffusibility are treated the same as a water absorption and diffusion area, which is different from the analysis by the inventors that the inside of the glove base is required to have relatively high water-absorbing properties and the outside of the glove base is required to have relatively high diffusibility. Moreover, as will be described further below, while the outside of the glove base is required to increase moisture mobility in the surface direction, only the water absorption and diffusion area is high in PTL 1, and, therefore, transmission of moisture from inside the glove base and the mobility of the transmitted moisture in the surface direction cannot be enhanced.

As a matter of course, in PTL 2, the mobility of moisture on the outside made of water-repellent fibers in the surface direction is low, which is different from the analysis of the item 2.

3: Measurements when a Coating is Provided

The fiber-made glove base may be used, at it is, as a glove. However, to improve gripping ability, durability, airtightness, waterproofness, and so forth, a coating may be required to be provided on at least part of its outer surface. This coating is often made of resin, and covers a part of the outside of the fiber-made glove base.

Thus, it is difficult for the fiber-made glove base to release the moisture absorbed from its surface to the outside environment. For example, when a coating is provided on the surface of the fiber-made glove of PTL 1, the surface is in a state of being covered. As described in the items 1 and 2, the glove of PTL 1 does not have high water-absorbing properties on the inside of the glove base in contact with the surface of the hand, high transmission ability of moisture from the inside to the outside, or high mobility of moisture on the outside in the surface direction. Thus, moisture on the surface of the hand absorbed by the inside is covered with the coating and cannot be released to the outside environment. The same goes for PTL 2.

From these analyses, and also in consideration of the possibility of providing a coating, the inventors have concluded that the fiber outside the glove base is required to have not only simple high moisture mobility but also high mobility in the surface direction. With this high mobility in the surface direction, moisture can move (moisture can be diffused) to an end part of the glove base that represents a break in the coating, such as at the wrist, and moisture is moved from this end part and released to outside air.

As described above, the inventors have concluded that three-dimensional moisture movement with high water-absorbing properties on the inside of the glove base in contact with the surface of the hand, high transmission ability of moisture from the inside to the outside, and high mobility of moisture on the outside in the surface direction is required to reduce moisture feelings in a fiber-made glove base. This is particularly required when a coating is provided on the surface of the fiber-made glove base.

The present invention was made based on these analyses.

General Overview

First, a general overview of the glove base in the first embodiment of the present invention is described.

FIG. 1 is a front view of a glove base according to a first embodiment of the present invention. A glove base 2 is used as a glove, and therefore has a hand shape. Here, corresponding to the use of the glove base 2 as a glove, the size of the glove base 2 may be specified by size such as S, M, L, LL, or so forth for manufacture.

The glove base 2 is manufactured by weaving fibers. Here, the glove base 2 includes first fibers 21 and second fibers 22. In FIG. 1, for understanding the invention, in the glove base 2, both of the first fibers 21 and the second fibers 22 are depicted. In reality, in the glove base 2, the first fibers 21 are exposed mainly to the inside (inner surface) of the glove base, and second fibers 22 are exposed mainly to the outside (outer surface) of the glove base. That is, since the first fibers 21 are mainly exposed to the inside of the glove base 2, the first fibers 21 are, in reality, not visible on the outer surface of the glove base 2 in FIG. 1.

Because of this structure, in the glove base 2, the first fibers 21 are mainly exposed to the inside of the glove base, and the first fibers 21 are in contact with the surface of the hand when a hand is inserted into glove base 2 (i.e., the glove base is worn). On the other hand, in the glove base 2, the second fibers 22 are mainly exposed to the outside of the glove base, and the second fibers 22 are exposed to the outside when the glove base 2 is worn. When the glove base 2 is used at it is as a glove, the second fiber 22 is mainly exposed to the outer surface of the glove. Alternatively, when a coating is provided to at least part of the outer surface of the glove base 2, the second fibers 22 are mainly exposed straight below the coating.

The water-absorbing properties of the first fibers 21 are higher than the water-absorbing properties of the second fibers 22. As a result, when the glove base 2 is worn on a hand, the first fibers 21 in contact with the surface of the hand absorb moisture on the surface of the hand. Furthermore, the first fibers 21 move the absorbed moisture from the surface of the hand to the second fibers 22. The second fibers 22 move the moisture from the first fibers 21 in a surface direction (i.e., direction B in FIG. 2).

Figure 2:
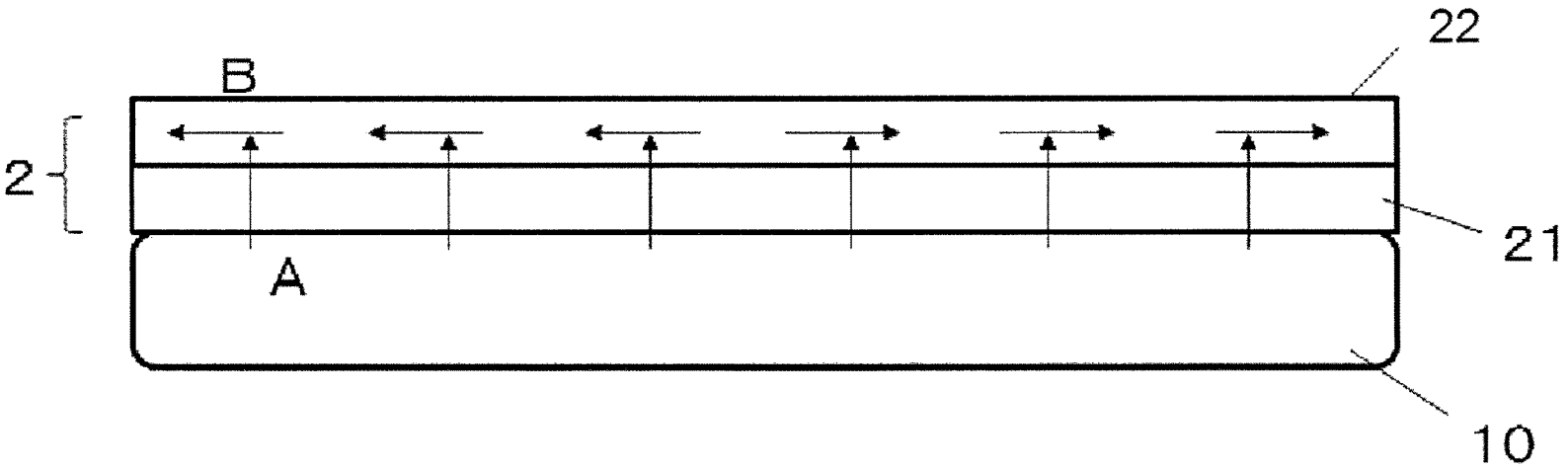
FIG. 2 is a schematic view depicting a moisture movement mechanism of the glove base in the first embodiment of the present invention.

Since the second fibers 22 have relatively lower water-absorbing properties compared with the first fibers 21, the moisture movement ability in the surface direction is relatively higher than moisture movement in a substantially perpendicular direction with respect to the surface direction (i.e., direction A in FIG. 2). Thus, the second fibers 22 enhance moisture diffusibility in the surface direction compared with the first fibers 21.

In this manner, in the glove base 2 of the first embodiment, the first fibers 21 are mainly exposed to the inside, and the second fibers 22 are mainly exposed to the outside. Having this structure, when the glove base 2 is used as a glove (including a case in which, for use as a glove, additional processing such as a coating on the surface is provided for use), the first fibers 21 mainly contact the surface of the hand. Since the first fibers 21 have water-absorbing properties that are higher than those of the second fibers 22, the first fibers 21 absorb moisture such as sweat on the surface of the hand. Here, with high water-absorbing properties, the first fibers 21 absorb moisture centrally in the substantially perpendicular direction.

Since the first fibers 21 and the second fibers 22 contact each other, the moisture absorbed by the first fibers 21 moves to the second fibers 22. Here, with the high water-absorbing properties, the first fibers 21 absorb moisture from the entire surface of the hand in the substantially perpendicular direction, and therefore, the first fibers 21 absorb moisture on the entire inside of the glove base 2. Thus, by using its entirety, the first fibers 21 inside the glove base 2 move the absorbed moisture to the second fibers 22.

The second fibers 22 receive moisture from the entire first fibers 21 in this manner by the movement in the substantially perpendicular direction and then move the moisture in the surface direction. During the movement in the surface direction, the second fibers 22 release moisture to the outside environment from the surface exposed to the outside (when the glove base 2 is used as a glove).

Also, by moving moisture in the surface direction, the second fibers 22 deliver the moisture to an end part of the glove base 2. For example, when a coating is provided to the outer surface of the glove base 2, it is difficult to release moisture from the surface of the glove base 2 where the second fibers 22 are exposed. Also in this case, the second fibers 22 move moisture to the end part of the glove base 2 along the surface direction. As a result, even if a coating is provided, the second fibers 22 efficiently move moisture to the end part, such as the wrist, which is a break in the coating. As a result of this movement, the second fibers 22 release moisture from this end part to the outside environment.

FIG. 2 is a schematic view depicting the moisture movement mechanism of the glove base in the first embodiment of the present invention. FIG. 2 depicts a state of a schematic cross section in a state in which the glove base 2 is worn on a hand 10.

In the glove base 2, the first fibers 21 are exposed to the inside of the glove base, and the second fibers 22 are exposed to the outside environment. Thus, the first fibers contact the surface of the hand 10. On the surface of the hand 10, moisture such as sweat is present. With high water-absorbing properties, the first fibers 21 absorb moisture on the surface of the hand 10 along an arrow A and in the substantially perpendicular direction. The first fibers 21 move the absorbed moisture toward the second fibers 22. As a matter of course, the first fibers 21 also move moisture in a direction other than the arrow A (surface direction and crossing direction). Compared with the second fibers 22, however, the moisture movement efficiency of the first fibers along the direction of the arrow A is high.

Next, the second fibers 22 move moisture in the planar surface direction along arrow B. With moisture movement in the surface direction along the arrow B, the second fibers 22 move moisture to an end part of the glove base. In addition to being able to release moisture from the surface with the movement, even if a coating is provided, the second fibers 22 release moisture from the end part as a break in the coating. As a matter of course, the second fibers 22 also move moisture in a direction other than the arrow B. However, the second fibers 22 have high diffusibility due to the lower water-absorbing properties than those of the first fibers 21. On this point, the second fibers 22 can move moisture centrally in the direction of arrow B.

With the combination of the first fibers 21 exposed mainly to the inside of the glove base and the second fibers 22 exposed mainly to the outside thereof, the above-described mechanisms function to cause the following operations.

Operation 1

With the first fibers 21 having high water-absorbing properties and absorbing moisture on the surface of the hand, particularly along the substantially perpendicular direction, a state in which hardly any moisture remains on the surface of the hand is maintained.

Operation 2

With the second fibers 22 moving moisture in the surface direction, moisture is also released from the end part of the glove base, in addition to the surface of the glove base 2.

Operation 3

In addition to Operation 2, even if a coating is provided on the outer surface of the glove base 2, the second fibers 22 release moisture from the end part of the glove base, which is a break in the coating.

With the above mechanisms and operations, the glove base 2 in the first embodiment reduces unpleasant moisture feelings due to moisture on the surface of the hand when the glove is worn.

Water-Absorbing Properties of the First Fibers

The water-absorbing properties of the first fibers 21 are 2.0 to 37.5 times greater with respect to the water-absorbing properties of the second fibers 22. For example, as the first fibers 21, at least one of cotton, hemp, silk, wool, rayon, cupra, and nylon with high moisture absorbing/releasing properties is used. These fibers have high water-absorbing properties.

By contrast, as the second fibers 22, at least one of normal nylon, polyester, vinylon, vinylidene, polypropylene, and polyethylene is used. These fibers have lower water-absorbing properties than those of the fibers listed as the first fibers 21.

For example, the official moisture regain of wool is 15.0%. On the other hand, the official moisture regain of polyester is 0.4%. Alternatively, the official moisture regain of cotton of the first fibers 21 is 8.5%, the official moisture regain of hemp is 12.0%, the official moisture regain of silk is 12.0%, the official moisture regain of rayon is 11.0%, and the official moisture regain of cupra is 11.0%.

On the other hand, the official moisture regain of nylon, which is the second fibers 22, is 4.5%, and the official moisture regain of vinylon is 5.0%. Also, the moisture absorbing/releasing properties of nylon with high moisture absorbing/releasing properties are twice as high as those of normal nylon or higher.

With this difference in water-absorbing properties, the water-absorbing properties of the first fibers 21 are 2.0 to 37.5 times that of the water-absorbing properties of the second fibers.

Here, the water-absorbing properties includes those defined by an amount of water absorption per unit area or unit volume.

Function of First Fibers

As the first fibers 21, any of the fibers as described above is used. The first fibers 21 are exposed mainly to the inside of the glove base 2. This is achieved by the way of weaving the glove base 2 described below. The first fibers 21 are not woven in a state of being separated from the second fibers 22, but are woven in a state where the first fibers 21 and the second fibers 22 are woven together.

The first fibers 21 have relatively high water-absorbing properties compared with the second fibers 22. When the glove base 2 is worn on the hand, the first fibers 21 are exposed to the inside of the glove base and contact the surface of the hand. The user wearing the glove sweats on the hand to cause moisture. The first fibers 21 absorb this moisture on the surface of the hand with its high water-absorbing properties.

In particular, the first fibers 21 absorb moisture on the surface of the hand and move moisture along the substantially perpendicular direction (in the thickness direction of the glove base material; Arrow A in FIG. 2). As a matter of course, moisture is moved also along a crossing direction and a surface direction but, due to the high water-absorbing properties, movement in the substantially perpendicular direction is sufficiently performed.

With this excellent moisture movement ability in the substantially perpendicular direction, the first fibers 21 quickly absorb moisture from the entire contact surface of the hand. Thus, the first fibers 21 exposed mainly to the inside of the glove base hardly leave any moisture on the contact surface of the hand.

The first fibers 21 move moisture absorbed from the surface of the hand, as it is, to the second fibers 22 mainly in the substantially perpendicular direction. By moving moisture to the second fibers 22, the first fibers 21 further absorb moisture from the surface of the hand easily. In this manner, the glove base 2 maintains a state where hardly any moisture remains on the surface of the hand by the first fibers 21.

Function of Second Fibers

The second fibers 22 move moisture from the first fibers 21 in a surface direction (planar direction; Arrow B in FIG. 2). As a matter of course, movement is made not only in the surface direction but also along the crossing direction and the substantially perpendicular direction, but movement is mainly in the surface direction. Since the water-absorbing properties of the second fibers 22 are lower than the water-absorbing properties of the first fibers 21, the second fibers 22 have stronger diffusibility in the surface direction than water absorption in the substantially perpendicular direction.

With this relative strength of diffusibility, the second fibers 22 move moisture from the first fibers 21 in the surface direction for diffusion. With this diffusion, when the glove base 2 is used as a glove, moisture is released to the outside using the wide surface direction.

In particular, the first fibers 21 absorb moisture from the surface of the hand evenly in the substantially perpendicular direction, but moisture is not present over the entire surface of the hand. That is, depending on the region, the first fibers 21 may have a site which does not absorb moisture. In the first fibers 21, a site which absorbs moisture and a site which cannot absorb moisture are distributed inside the glove base 2.

When moisture absorbed by the first fibers 21 is unevenly distributed depending on the site of the glove base 2 as described above, if the second fibers 22 also have the same function of moisture movement as that of the first fibers 21, the second fibers 22 cannot utilize the entire glove base 2 to move and release moisture.

By contrast, the second fibers 22 of the first embodiment move moisture mainly in the surface direction, thereby spreading moisture across the entire glove base 2 in the course of movement. By being capable of using the entire glove base 2, the second fibers 22 move and diffuse moisture for release to the outside environment, without being inferior to the moisture absorbing speed by the first fibers 21.

Also, even if a coating is provided to the outer surface of the glove base 2, the second fibers 22 move moisture along the surface direction, and can therefore move moisture to an end part of the glove base 2. The end part of the glove base 2 is often a wrist portion of the glove base 2. For example, even if a coating is provided to the surface of the glove base 2, the second fibers 22 can move moisture to the wrist portion as a break in the coating for release to the outside environment.

Alternatively, the second fibers 22 can also move moisture to a portion where a coating is not provided, other than the wrist. The second fibers 22 can move moisture along the entire outside of the glove base 2 in the surface direction, and therefore can move it to a portion where a coating is not provided for release to the outside.

As described above, the moisture mobility of the first fibers 21 is higher in the substantially perpendicular direction than in the surface direction, and the moisture mobility of the second fibers 22 is higher in the surface direction than in the substantially perpendicular direction.

When the Glove is Provided with a Coating

Figure 3:
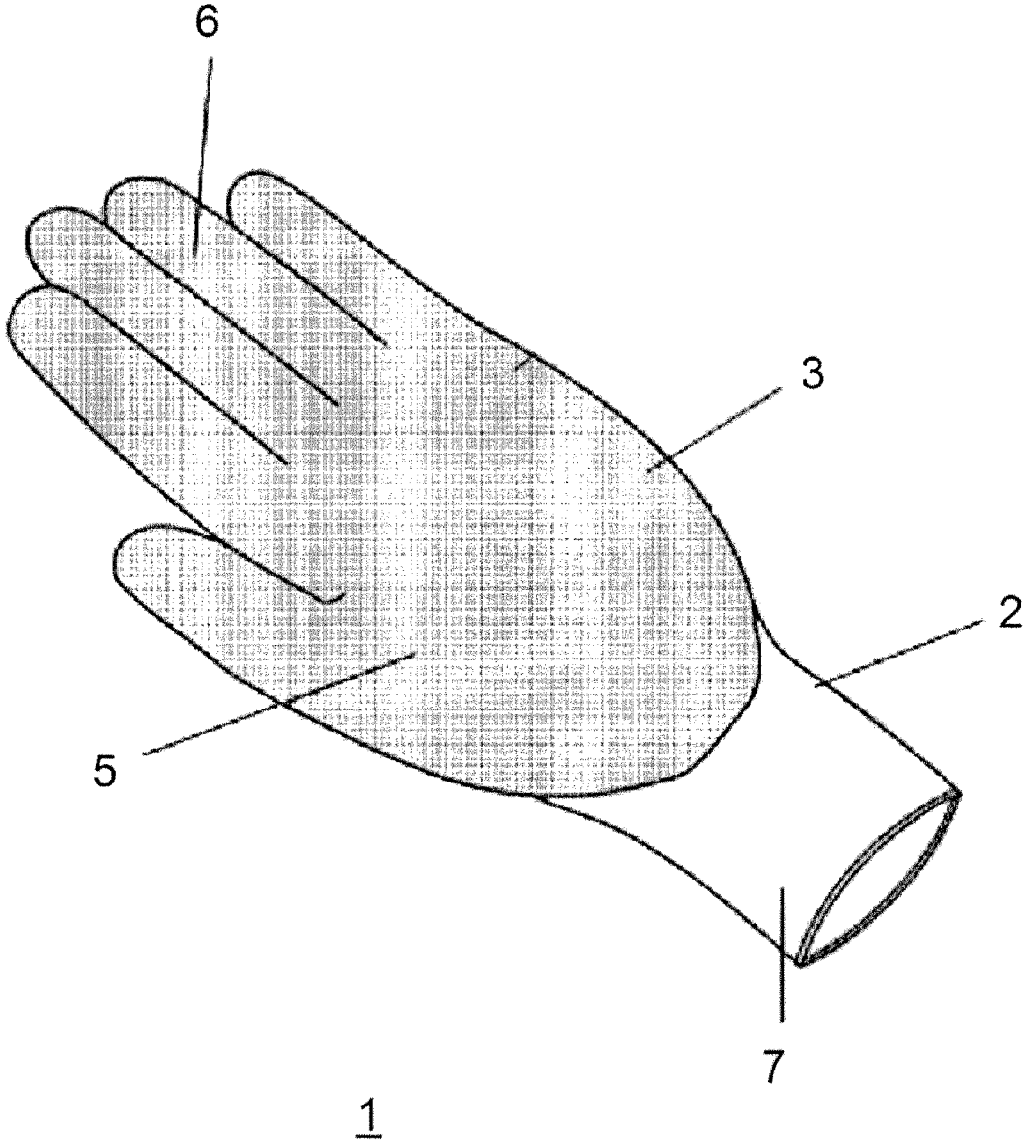
FIG. 3 is a perspective view of a glove in the first embodiment of the present invention.

FIG. 3 is a perspective view of the glove in the first embodiment of the present invention. A glove 1 of FIG. 3 is provided with a coating 3 on the outer surface of the glove base 2. The coating 3 is formed by immersion in a coating liquid such as a resin liquid and then drying. In the glove 1 of FIG. 3, the coating 3 is formed on a palm of a hand, 5, and a finger part 6. On the other hand, the coating 3 is not formed on a wrist portion 7. The coating 3 is often provided to enhance waterproofness, airtightness, and gripping ability. Thus, the coating 3 is required for the palm of the hand, 5, and the finger part 6 with which the user wearing the glove 1 actually grabs a substance.

However, the coating 3 to support the above object is often unnecessary for the wrist portion 7. Thus, the glove 1 the coating 3 is often not provided to the wrist portion 7.

As described above, the second fibers 22 move moisture in the surface direction. By being moved in the surface direction, moisture absorbed by the first fibers 21 exposed to the inside of the glove base 2 constituting the glove 1 and moved to the second fibers 22 can be moved by the second fibers 22 to this wrist portion 7. For example, moisture absorbed by the first fibers 21 in contact with the palm of the hand inside the glove base is moved from the first fibers 21 through the second fibers 22 to the wrist portion 7.

As depicted in FIG. 3, in the glove 1, the coating 3 is not provided to the wrist portion 7. That is, the second fibers 22 are exposed to the surface of the glove 1. With this exposure, the second fibers 22 can release the moved moisture to the outside from the wrist portion 7.

In this manner, even if the coating 3 is provided and used as the glove 1, the glove base 2 moves moisture also to a portion that is not provided with the coating 3, and can release the moved moisture from this portion not provided with the coating 3.

Figure 4:
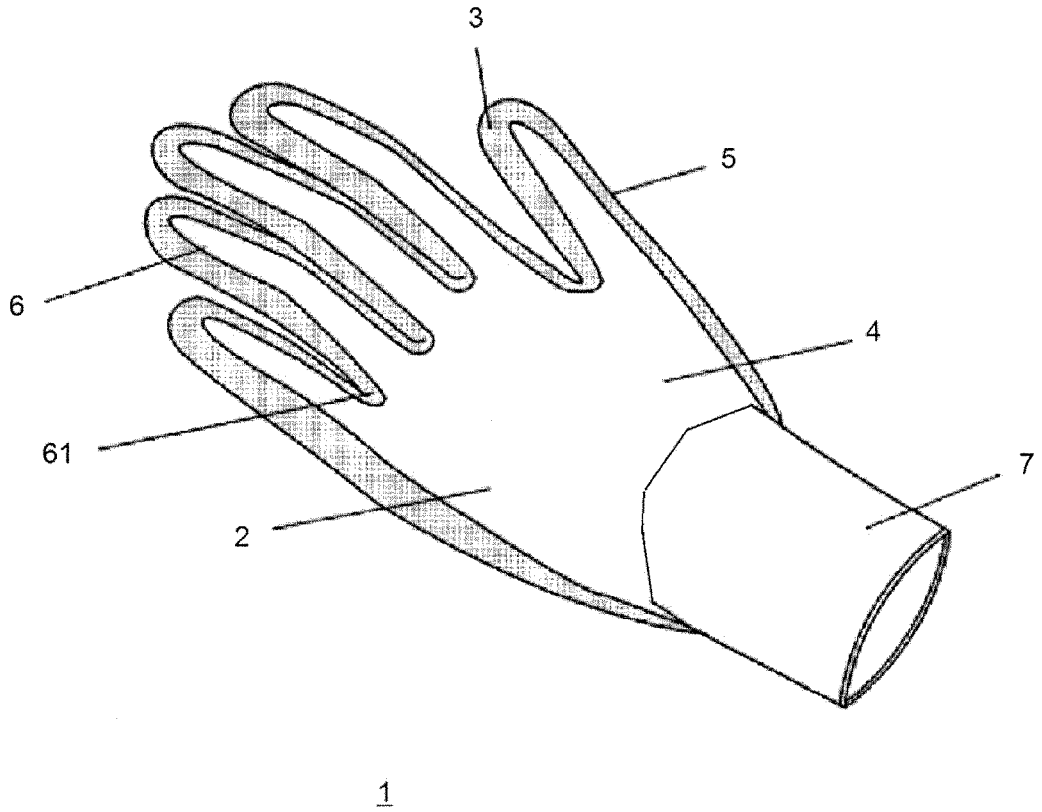
FIG. 4 is a rear view of the glove in the first embodiment of the present invention.

FIG. 4 is a rear view of the glove in the first embodiment of the present invention. In the glove 1 of FIG. 4, the coating 3 is formed on the front side (palm side) 5 of the hand of the glove base 2, but the coating 3 is not formed on the other opposite, back side 4 of the hand. Similarly, the coating 3 is also not formed on the wrist portion 7. For example, when the coating 3 to enhance gripping ability is provided, the coating 3 is not provided to the back side of the hand 4, which is the back of the glove 1, as described above.

Also in this case, the second fibers 22 move moisture along the surface direction. While moisture is released to the outside from the surface of the glove base 2 at the back side of the hand 4, which is not provided with the coating 3 in the course of movement, moisture that has reached the wrist portion 7 can be released from the wrist portion 7 to the outside environment.

As described above, by moving moisture in the surface direction, the second fibers 22 release moisture from a portion not provided with the coating 3 or an end portion even if the glove 1 is provided with the coating 3. With this release of moisture to the outside by this movement in the surface direction, the moisture absorbed by the first fibers 21 can be released from a portion in contact with the outside early. As a result, even if the coating 3 is provided on the glove base 2, moisture hardly remains on the surface of the hand. As a matter of course, since moisture in the first fibers 21 in contact with the surface of the hand is also moved by the second fibers 22 for release to the outside, hardly any moisture remains in the first fibers 21.

In this manner, by combining the different structures and mechanisms of the first fibers 21 and the second fibers 22, the glove base 2 in the first embodiment releases moisture from a portion of the glove base not provided with the coating 3, even if the coating 3 is provided to other portions of the outer surface of the glove base. Thus, even if the glove base 2 is used as a glove or is used as a glove 1 with the coating 3 provided thereto, uncomfortable moisture feelings upon wearing can be reduced.

Second Embodiment

Next, a second embodiment is described. In the second embodiment, a method of achieving a structure in which the first fibers 21 are exposed mainly to the inside of the glove base and the second fibers 22 are exposed mainly to the outside in the glove base 2 is described.

Figure 5:
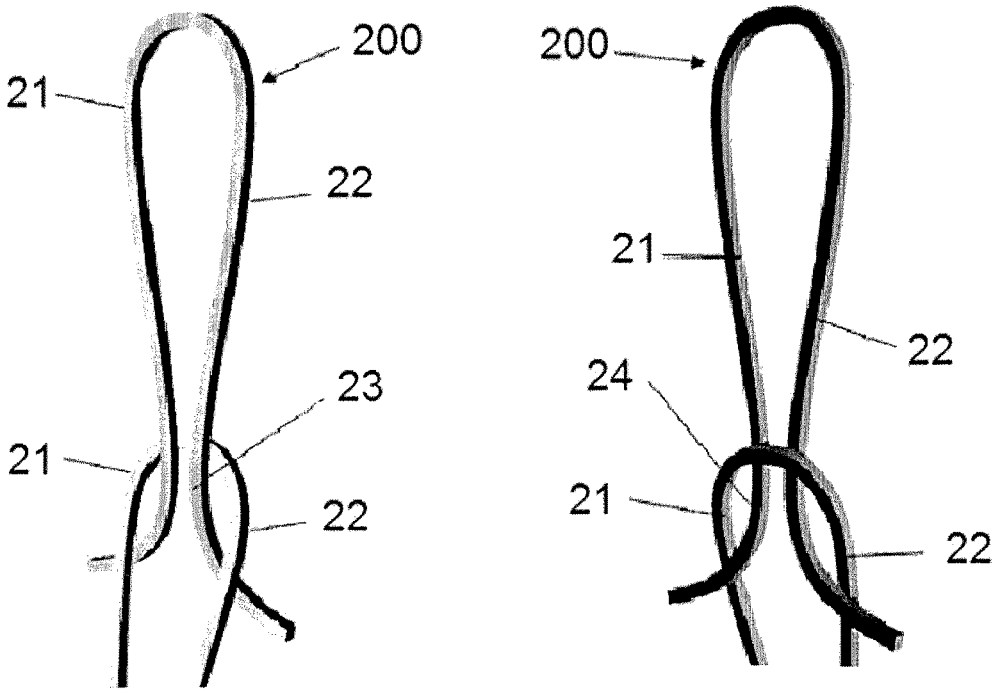
FIG. 5 is a schematic view for describing the plating stitch according to a second embodiment of the present invention.

FIG. 5 is a schematic view describing a plating stitch according to the second embodiment of the present invention. By using a plating stitch in the glove base 2 described in the first embodiment, it is possible to expose the first fibers 21 mainly to the inside of the glove base and expose the second fibers 22 mainly to the outside.

The plating stitch is also called a plated stitch, and is a method of knitting performed by simultaneously supplying a main string and an appendant string to a knitting needle for knitting. With this knitting method, the main string is exposed to the outside of the glove base 2 to be knitted, and the appendant string is exposed to the inside of the glove base 2 to be knitted. With this exposure, by plating stitch of letting the main string and the appendant string simultaneously passing through the knitting needle, the main string, which is one fibers, is exposed mainly to the inside of the glove base 2. The appendant string, which is the other fiber, is exposed mainly to the outside of the glove base 2.

That is, if the glove base 2 is knitted by plating stitch with the main string as the second fibers 22 and the appendant string as the first fibers 21, the first fibers 21 are exposed mainly to the inside and the second fibers 22 are exposed mainly to the outside.

A plated fiber 200 of FIG. 5 includes the first fibers 21 and the second fibers 22. While the state is such that the first fibers 21 and the second fibers 22 are separated, the state may be such that the first fibers 21 and the second fibers 22 are combined into the fiber 200.

As in FIG. 5, the fiber 200 is configured in a U shape, and this U-shaped portion is allowed to pass through another site of the fiber 200. By continuing this work of letting the U-shaped portion pass through another site, the first fibers 21 are exposed to an inside portion 23, and the second fibers 22 are exposed to an outside portion 24. This plating stitch is continued to form the glove base 2.

In the glove base 2 formed as described above, the first fibers 21 are exposed mainly to the inside of the glove base, and the second fibers 22 are exposed mainly to the outside.

Formation of Coating

The coating 3 is formed by immersing the glove base 2 in a coating liquid such as a resin liquid to form the coating 3. The resin liquid is accommodated in a container, and the surface of the glove base 2 is immersed in this resin liquid, and the resin liquid infiltrates into the glove base 2. Then, the resin liquid is dried to form the coating 3 on the glove base 2. By appropriately changing a site to be immersed in the resin liquid, the coating 3 can be formed at various sites on the surface of the glove base 2.

Here, when the coating 3 is formed, it is suitable that immersion is performed in a coagulating liquid before immersion in the resin liquid for coating. This is because the coating 3 becomes less prone to reach the inner surface of the glove base 2. Also, with coagulating-liquid immersion, when the coating 3 is formed, the resin liquid for the coating 3 is dried early, and the time for forming the coating 3 is reduced. With this time reduction, the coating 3 is formed neatly. In addition with the time reduction, the resin liquid is dried early, and therefore, the resin liquid becomes less prone to infiltrate into the inner surface of the glove base 2. Also at this point, with the coagulating liquid, the resin liquid to form the coating 3 becomes less prone to infiltrate into the inner surface of the glove base 2.

Results of Experiment to Reduce Moisture Feelings of the Glove

Next, the results of an experiment to reduce moisture feelings in the glove using the glove base described in the first and second embodiments of the present invention are described. In the experiment, a glove with a coating provided to a surface of a glove base manufactured by using the first fibers exposed mainly to the inside of the glove base and the second fibers exposed mainly to the outside of the glove base described in the first and second embodiments of the present invention was manufactured for the experiment.

To reduce moisture feelings, as described in the first and second embodiments, it is required that the inside of the glove base have excellent water-absorbing properties (moisture-absorbing properties) and that the outside have excellent releasing properties (moisture-releasing properties). The inventors actually manufactured a glove from the first fibers and the second fibers, then also provided coating thereto, and compared the moisture-absorbing properties and moisture-releasing properties of the glove in this state between examples and a comparative example. As described above, if high moisture-releasing properties in addition to high moisture-absorbing properties can be confirmed in the glove as a whole, superiority required for reducing moisture feelings can be confirmed. The inventors manufactured gloves corresponding to the examples and a glove as a comparative example as depicted in Table 1, and compared the moisture-absorbing properties and moisture-releasing properties of the gloves being set in a thermo-hygrostat bath with predetermined moisture and temperature.

TABLE 1

| Sample No. | Coating | Yarn structure: First fiber | Yarn structure: Second fiber | Moisture absorbing amount (g/Hr) | Moisture releasing amount (g/Hr) | Moisture absorbing ratio (wt %/Hr) | Moisture releasing ratio (wt %/Hr) |
|---|---|---|---|---|---|---|---|
| Example 1 | PU (Finger NBR) | Nylon with high moisture absorbing/releasing properties | One string of normal nylon | 0.50 | 0.04 | 2.9% | 0.25% |
| Example 2 | PU (Finger NBR) | Nylon with high moisture absorbing/releasing properties | Two strings of normal nylon | 0.72 | 0.10 | 3.5% | 0.46% |
| Comparative Example 1 | PU (Finger NBR) | Two strings of normal nylon | | 0.45 | −0.03 | 2.4% | −0.18% |

Examples and comparative examples in Table 1 are as follows.

Example 1

In the glove of Example 1, a glove base manufactured by using nylon with high moisture absorbing/releasing properties as first fibers and using one string of normal nylon as a second fiber. Furthermore, in Example 1, the glove is provided with coating of polyurethane (PU) (with finger tips further provided with coating of nitrile rubber (NBR)). In each of Example 1 to Comparative Example 4, by providing a coating on the surface of the glove base, the experiment is further made in a state of being difficult to reduce moisture feelings. If the Examples are superior to the Comparative Example, even in this state of being difficult to reduce moisture feelings, it is possible to demonstrate that the glove base described in the first and second embodiments is superior in reducing moisture feelings.

Example 2

In the glove of Example 2, a glove base manufactured using nylon with high moisture absorbing/releasing properties as a first fiber and using two strings of normal nylon as a second fiber. Furthermore, the glove is provided with coating of polyurethane (PU) (with finger tips further provided with coating of nitrile rubber (NBR)).

Comparative Example 1

In a glove of Comparative Example 1, a glove base with all of the fibers being two strings of normal nylon is used. Furthermore, the glove is provided with coating of polyurethane (with finger tips further provided with coating of nitrile rubber (NBR)).

The experiment procedure is as follows. Note that each term is defined as follows.

Absolute dry state: A state in which a target glove is dried for one hour by an oven at a temperature of 85° C.

Moisture-absorbing state: A state in which a target glove is left standing for one hour inside a thermo-hygrostat bath at a temperature of 40° C. and a humidity of 90%.

Moisture-releasing state: A state in which a target glove is left standing for one hour inside a thermo-hygrostat bath at a temperature of 20° C. and a humidity of 65%.

Measurement of Moisture Absorbing Amount and Moisture Absorbing Ratio The gloves of Example 1 to Comparative Example 1 in an absolute dry state are placed for one hour inside a thermo-hygrostat bath in a moisture-absorbing state. Then, the moisture absorbing amount and the moisture absorbing ratio of the target gloves are measured. The moisture absorbing amount and the moisture absorbing ratio are computed by formulas as follows.

Moisture absorbing amount (g)=glove weight (g) in a moisture-absorbing state−glove weight (g) in an absolute dry state Moisture absorbing ratio (%)=(glove weight (g) in a moisture-absorbing state−glove weight (g) in an absolute dry state)/glove weight (g) in an absolute dry state×100

Measurement of Moisture Releasing Amount and Moisture Releasing Ratio

The gloves of Example 1 to Comparative Example 1 in a moisture-absorbing state are placed for one hour inside a thermo-hygrostat bath in a moisture-releasing state. Then, the moisture releasing amount and the moisture releasing ratio of the target gloves are measured. The moisture releasing amount and the moisture releasing ratio are computed by formulas as follows.

Moisture releasing amount (g)=glove weight (g) in a moisture-absorbing state−glove weight (g) in a moisture-releasing state Moisture releasing ratio (%)=(glove weight (g) in a moisture-absorbing state−glove weight (g) in a moisture-releasing state)/glove weight (g) in an absolute dry state×100

The moisture absorbing amount, the moisture absorbing ratio, the moisture releasing amount, and the moisture releasing ratio of each of Example 1 to Comparative Example 1 measured in the above experiment procedure are as depicted in Table 1. In the following, each is described.

Moisture Absorbing Amount

The moisture absorbing amount of Example 1 is 0.50 g/Hr. The moisture absorbing amount of Example 2 is 0.72 g/Hr. By contrast, the moisture absorbing amount of Comparative Example 1 is 0.45 g/Hr.

That is, the moisture absorbing amounts of Examples 1 and 2 are higher with respect to Comparative Example 1. Even in a case of being put in the thermo-hygrostat bath with humidity, the gloves of Examples 1 and 2 have a relatively high moisture absorbing amount. As a result, the gloves of Examples 1 and 2 can absorb sweat and moisture on the surface of the hand in a short period of time when attached to the hand.

Moisture Releasing Amount

The moisture releasing amount of Example 1 is 0.04 g/Hr. The moisture releasing amount of Example 2 is 0.10 g/Hr. By contrast, the moisture releasing amount of Comparative Example 1 is −0.03 g/Hr.

The moisture releasing amounts of Examples 1 and 2 are higher with respect to Comparative Example 1. That is, the gloves of Examples 1 and 2 can efficiently release absorbed sweat and moisture from the hand to the outside when worn.

These are also manifested in the moisture absorbing ratio and the moisture releasing ratio. Both the moisture absorbing ratio and the moisture releasing ratio of the gloves of Examples 1 and 2 are higher than those of Comparative Example 1.

That the moisture absorbing amount (moisture absorbing ratio) and the moisture releasing amount (moisture releasing ratio) are high indicates that the glove can efficiently absorb sweat and moisture on the surface of the hand in a short period of time when attached to the hand and can also early and efficiently release the absorbed moisture to the outside. With these characteristics, even if the glove is attached, moisture feelings on the hand can be reduced.

As described above, it has been confirmed also from the experiment depicted in Table 1 that the glove base and glove of the present invention can reduce moisture feelings when worn.

Third Embodiment

A third embodiment is described next. In the third embodiment, it is described that twisted union yarn formed of first fibers and second fibers is used to manufacture a glove base material, thereby achieving the glove base described in the first and second embodiments.

Figure 6:
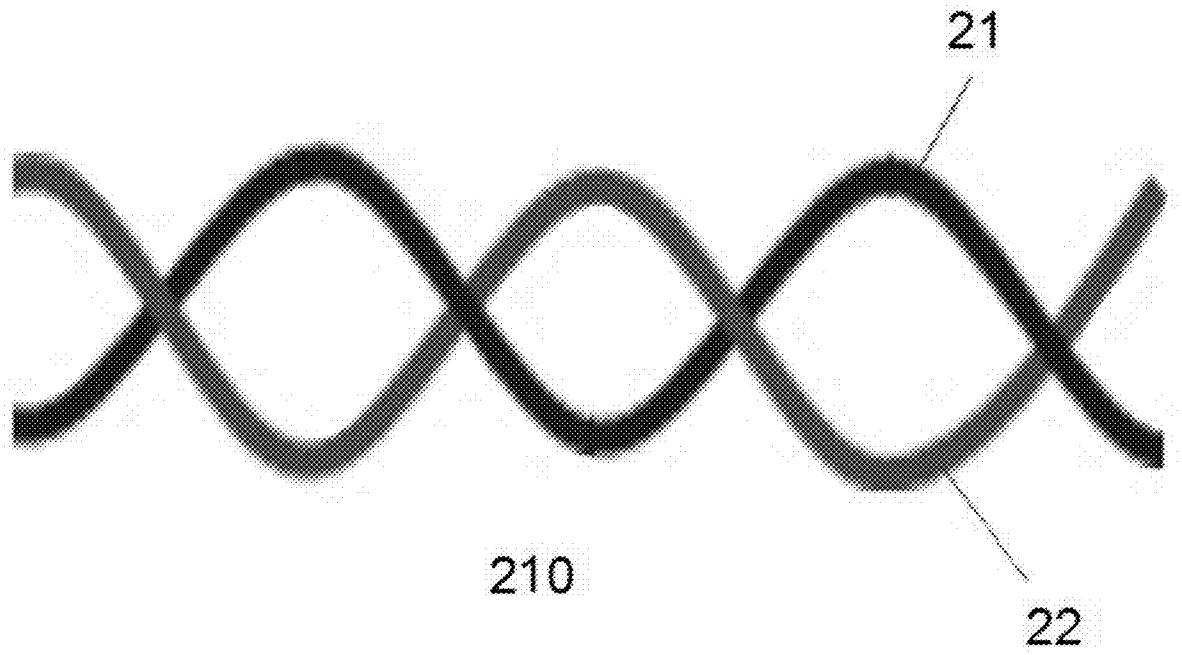
FIG. 6 is a schematic view of twisted union yarn according to a third embodiment of the present invention.

FIG. 6 is a schematic view of twisted union yarn in the third embodiment of the present invention. Twist union yarn 210 is yarn made by twisting the first fibers 21 and the second fibers 22 together to form one string. That is, by using this twisted union yarn 210 when the glove base 2 is manufactured, the first fibers 21 and the second fibers 22 are both used for weaving with one string of yarn.

When the glove base 2 is manufactured by using this twisted union yarn 210, one fibers contained in the twisted union yarn 210 is exposed to the inside of the glove base 2 and the other fiber is exposed to the outside of the glove base 2. Since the twisted union yarn 210 has the first fibers 21 and the second fibers 22, the first fibers 21 are exposed to the inside of the glove base 2 and the second fibers 22 are exposed to the outside of the glove base 2.

In this manner, when the twisted union yarn 210 is used, the glove base 2 made of the first fibers 21 and the second fibers 22 is manufactured by manufacturing one string of yarn. Furthermore, the first fibers 21 are exposed to the inside and the second fibers 22 are exposed to the outside. By using the twisted union yarn 210, the glove base 2 described in the first and second embodiments can be manufactured.

For example, as the first fibers 21, any of cotton, hemp, silk, wool, rayon, cupra, and nylon with high moisture absorbing/releasing properties is used. As the second fibers 22, any of normal nylon, polyester, vinylon, vinylidene, polypropylene, and polyethylene is used. If the twisted union yarn 210 with the first fibers 21 and the second fibers 22, which are each any of these fibers, being twisted is used, the glove base 2 can be achieved in which the inside absorbs moisture on the surface of the hand and moves it to the second fibers 22 and the outside moves the moisture moved from the first fibers 21 mainly in the surface direction.

Also, by changing respective tinting colors of the first fibers 21 and the second fibers 22 forming the twisted union yarn 210, main exposure of the first fibers 21 and the second fibers 22 to the inside and the outside, respectively, can be easily confirmed. As a matter of course, this has a merit also in design, such as a varicolored pattern.

As described in the foregoing, the glove base and glove described in the first to third embodiments are examples for describing the gist of the present invention and include modifications and alterations within a range not deviating from the gist of the present invention.

REFERENCE SIGNS LIST

1 glove
2 base
21 first fibers
22 second fibers
3 coating
4 back of a hand
5 palm of a hand
6 finger part
7 wrist portion
10 hand
200 plated fiber
210 twisted union yarn

The invention claimed is:

1. A glove base for a glove for absorbing moisture from a wearer's hand when worn, the glove base comprising:

a glove base material shaped in the form of a hand and configured to conform to the hand of a wearer;

wherein said glove base material is formed of twisted union yarns comprising fibers including first fibers having water-absorbing properties and second fibers having water-absorbing properties;

wherein the water-absorbing properties of the first fibers of the yarns of the glove base material are higher than that of the second fibers of the yarns of the glove base material;

wherein the first fibers of the yarns of the glove base material are exposed mainly on an inside surface of the glove base adjacent to a surface of the hand of the wearer, and the second fibers of the yarns of the glove base material are exposed mainly on an outer surface of the glove base;

wherein the first fibers of the yarns of the glove base material absorb and move moisture on the inside surface of the glove base adjacent to the surface of the hand of the wearer toward the second fibers of the yarns of the glove base material proximate the outer surface of the glove base; and wherein the second fibers of the yarns of the glove base material move the moisture from the first fibers of the yarns of the glove base material along a surface direction of the glove base material, thereby assisting in the movement of the moisture away from the hand of the wearer proximate the inside surface of the glove base along the outer surface of the glove base.

2. The glove base according to claim 1, wherein the water-absorbing properties of the first fibers are 2.0 to 37.5 times that of the water-absorbing properties of the second fibers.

3. The glove base according to claim 1, wherein the water-absorbing properties include an amount of water absorption per unit area or unit volume.

4. The glove base according to claim 1, wherein the first fibers of the yarns of the glove base material move the moisture absorbed from the surface of the hand of a wearer inside the glove base in a substantially perpendicular direction from the inside surface of the glove base material toward the second fibers on the outer surface of the glove base material.

5. The glove base according to claim 1, wherein the second fibers of the yarns of the glove base material move the moisture from the first fibers toward the outer surface of the glove base material and along the outer surface of the glove base material toward an end part of the glove base.

6. The glove base according to claim 5, wherein the end part of the glove base is an end part of a wrist portion of the glove base.

7. The glove base according to claim 1, wherein when a coating is provided to at least apart of a front side of the outer surface of the glove base, the second fibers of the yarns of the glove base material move the moisture from the first fibers of the yarns of the glove base material to a portion of the glove base that not provided with the coating so as to release the moisture to outside air.

8. The glove base according to claim 1, wherein a moisture mobility of the first fibers of the yarns of the glove base material is higher in the substantially perpendicular direction of the glove base material than in the surface direction of the glove base material, and wherein a moisture mobility of the second fibers of the yarns of the glove base material is higher in the surface direction of the glove base material than in the substantially perpendicular direction of the glove base material.

9. The glove base according to claim 1, wherein the first fibers of the yarns of the glove base material include at least one type of fiber selected from the group consisting of cotton, hemp, silk, wool, rayon, cupra, and nylon with high-moisture absorbing/releasing properties.

10. The glove base according to claim 1, wherein the second fibers of the yarns of the glove base material include at least one type of fiber selected from the group consisting of nylon, polyester, vinylon, vinylidene, polypropylene, and polyethylene.

11. The glove base according to claim 9, wherein the moisture absorbing/releasing properties of the nylon with moisture absorbing/releasing properties of the first fibers of the yarns of the glove base material are at least twice as high as a moisture absorbing/releasing property of the nylon of the second fibers of the yarns of the glove base material.

12. A glove comprising the glove base material according to claim 1.

* * * * *